United States Patent [19]

Yasujima et al.

[11] 4,444,860

[45] Apr. 24, 1984

[54] LAYERED PERSISTENT PHOTOCONDUCTIVE ELEMENT COMPRISES PIGMENT LAYER AND POLYMER LAYER CONTAINING POLYVINYL CARBAZOLE

[75] Inventors: Akitaka Yasujima; Sumitaka Nogami, both of Yokohama; Yoshiharu Kitahama, Kawasaki; Isamu Iwami, Zushi, all of Japan

[73] Assignee: Asahi Kasei Kogyo Kabushiki Kaisha, Osaka, Japan

[21] Appl. No.: 446,668

[22] Filed: Dec. 3, 1982

[30] Foreign Application Priority Data

| | | | |
|---|---|---|---|
| Jul. 12, 1981 | [JP] | Japan | 56-195586 |
| Sep. 12, 1981 | [JP] | Japan | 56-196959 |
| Sep. 30, 1982 | [JP] | Japan | 56-169601 |
| Sep. 30, 1982 | [JP] | Japan | 57-169602 |

[51] Int. Cl.[3] ..... G03G 5/024; G03G 5/07

[52] U.S. Cl. ..... 430/57; 430/51; 430/76

[58] Field of Search ..... 430/51, 57, 73, 76

[56] References Cited

U.S. PATENT DOCUMENTS

| | | | |
|---|---|---|---|
| 3,113,022 | 12/1963 | Cassiers et al. | 430/97 |
| 3,512,966 | 5/1970 | Shattuck et al. | 430/19 |
| 3,879,201 | 4/1975 | Williams et al. | 430/19 |
| 3,997,342 | 12/1976 | Bailey | 430/58 |
| 4,033,769 | 7/1977 | Williams et al. | 430/80 |

FOREIGN PATENT DOCUMENTS

| | | |
|---|---|---|
| 50-86347 | 7/1975 | Japan . |
| 50-86348 | 7/1975 | Japan . |
| 52-4839 | 1/1977 | Japan . |
| 56-17537 | 2/1981 | Japan . |
| 56-17538 | 2/1981 | Japan . |

OTHER PUBLICATIONS

"Persistent Conductivity in Organic Photoconductors", Tappi, 56 No. 6, pp. 129–133 (1973) by D. J. Williams et al.

*Primary Examiner*—John D. Welsh

*Attorney, Agent, or Firm*—Armstrong, Nikaido, Marmelstein & Kubovcik

[57] ABSTRACT

A persistent photoconductive element comprising an electroconductive support, a pigment layer formed on said support and composed mainly of a phthalocyanine pigment or Indanthrene Blue GCD and a polymer layer formed on said pigment layer and composed mainly of a polyvinyl carbazole, said polymer layer containing at least one member selected from the group consisting of aliphatic halogenated hydrocarbons, halogenated acyl compounds, halogenated keto compounds and hydrogen donor compounds. This element exhibits an improved photoconductive sensitivity and prolonged photoconductivity over the prior art, whereby it is highly useful in electrophotographic processes requiring persistent photoconductivity. Additives, such as plasticizer and binding agent, may be incorporated in the polymer and pigment layers to improve the flexibility and mechanical durability of the persistent photoconductive element.

8 Claims, No Drawings

LAYERED PERSISTENT PHOTOCONDUCTIVE ELEMENT COMPRISES PIGMENT LAYER AND POLYMER LAYER CONTAINING POLYVINYL CARBAZOLE

This invention relates to a persistent photoconductive element. More particularly, this invention is concerned with a persistent photoconductive element comprising an electroconductive support and, superimposed thereon, a pigment layer and a polymer layer.

Various types of photoconductive elements are known for use in electrophotographic imaging processes, in which first, the surface of a photoconductive element is electrostatically charged uniformly; second, the electrostatically charged surface is image-wise exposed to light radiation (light irradiated portions of the surface thus rendered electroconductive so that the electrostatic charge is selectively dissipated in the irradiated portions) to form a latent electrostatic image on said surface; third, the latent electrostatic image is rendered visible by development with a finely divided colored electroscopic material, known in the art as "toner"; and last, the developed image is transferred to another surface, such as a sheet of paper, and affixed thereto. When a plurality of copies are desired, there is ordinarily adopted a method in which the above steps are repeated.

As another means for obtaining a plurality of copies, there has been proposed a method which utilizes the property of a photoconductive element which upon a single image-wise exposure, permits an electrical image to be generated and persist over a period of time sufficient to produce (from that one electrical image) a plurality of image copies. In this method, first, a photoconductive element which exhibits persistent photoconductivity can be given an initial uniform electrostatic charge; second, the element is exposed to an initial image-wise radiation pattern to form a latent electrical image; third, the latent electrical image is developed by application of a toner; and last, the resultant toner image is transferred to a receiver sheet to form a first copy corresponding to the original image-wise exposure. The photoconductive element bearing the original latent electrical image (by virtue of the persistent character of this electrical image) can then be re-charged by application of an electrical field, e.g. by application of a uniform electrostatic charge, and, in the absence of any image-wise re-exposure, one obtains a developable, latent electrical image corresponding to the original image-wise exposure so that a second copy of the original image-wise exposure can be generated. In this manner, a plurality of copies can be obtained. This reproduction system is interesting because a time saving can be attained owing to omission of the exposure-step repetition and from the viewpoint of a deterioration prevention of the photoconductive element.

Heretofore, there have been proposed several organic photoconductive elements having the above-mentioned photoconductive properties.

For example, there is disclosed in U.S. Pat. No. 3,113,022 an electrophotographic copying process which comprises the steps of exposing an uncharged layer consisting essentially of at least one organic polymeric photoconductive insulating substance and a diazonium salt corresponding to the following general formula:

$$[R-N_2^+]_nX$$

wherein:

R is an aryl radical,

X is an anion, and n is a positive number equal to the valence of X, uniformly distributed therethrough, imagewise to electromagnetic radiation to which said layer is sensitive, whereby a latent conductive image is produced in said layer, subjecting said layer in absence of electromagnetic radiation to which the layer is sensitive to an electric field to create in said layer a pattern of electrostatic charges in conformity with said latent conductive image, and developing said pattern of electrostatic charges with electrostatically attractable material. However, the photoconductive element employed according to this reference has a poor sensitivity and cannot be subjected to repeated use by erasure.

There is disclosed in U.S. Pat. No. 3,512,966 a process of forming a latent conductive pattern in an organic photoconductive layer and subsequently erasing said photoconductive pattern, which process comprises the steps of first, selectively exposing an uncharged organic photoconductive layer comprising polyvinyl carbazole, a dye-stuff sensitizer, and a dinitro-substituted benzoic acid, to electromagnetic radiation to which said layer is sensitive, whereby a latent conductive pattern is produced in the exposed areas of said layer and remains after the electromagnetic radiation is removed; second, uniformly electrostatically charging said photoconductive layer to form a electrostatic charge pattern corresponding to the non-conductive areas of the photoconductive layer, third, developing said photoconductive layer with a developer material to form a visible pattern; fourth, transferring said visible pattern from said photoconductive layer and cleaning any residual developer material from the photoconductive layer; and last, heating the photoconductive layer at a temperature within the range of about 100°–150° C. and not longer than about 5 seconds whereby said latent conductive pattern is erased. However, as is commented on in the specification of U.S. Pat. No. 3,829,201, the sensitivity of this one-layer type photoconductive element is insufficient.

There is disclosed in U.S. Pat. No. 3,879,201 a photoconductive element on which the persistent photoconductivity can be erased by heat so that the element can be reutilized for reproduction. This photoconductive element is a monolayer type photoconductive element comprising a photoconductive polymer such as polyvinyl carbozole, an activator capable of forming a charge transfer complex with the photoconductive polymer and protonic acid. According to the teachings of the Examples, a considerable quantity of light exposure is necessary for obtaining a persistent photoconductivity, and hence, the sensitivity of this photoconductive element is low. Furthermore, in case of this photoconductive element, the number of copies obtainable by one exposure is limited.

Further, there is disclosed in U.S. Pat. No. 3,997,342 a persistent photoconductive element having at least two layers, which comprises a charge-generation layer and a charge-transport layer. In this photoconductive element, the charge-generation layer comprises a finely divided particulate co-crystalline complex of a polymer having an alkylidene diarylene group in a recurring unit and a pyrylium-type dye salt, and the charge-transport layer is composed of an organic photoconductive material. A protonic acid is contained in at least one of these two layers. For this persistent photoconductive element, the persistent photoconductivity can be erased by heat so that the element can be reutilized for reproduction. From the description of the specification and Examples of this U.S. patent, the photoconductive element exhibits an improved sensitivity over those of the prior art. However, the sensitivity of the photoconductive element has not been so improved that the element cannot be actually rendered operable with a quantity of light exposure experienced with the conventional copy-duplicating machines. Further, the adaptability to repeated use is evaluated after only ten cycles, and hence, it is indefinite how many copies can practically be obtained by one exposure.

There is a continuous demand in the art for a persistent photoconductive element having such an increased sensitivity as renders the element actually operable with a quantity of light exposure experienced with the conventional copy-duplicating machines, retaining a photoconductivity even after repeated electro-charging to produce a plurality of copies upon one exposure, and permitting the persistent photoconductivity to be erased so that the element can be reutilized for reproduction.

With a view to developing such a desirable persistent photoconductive element, we have made extensive and intensive studies on the effect of photoconductive element structures and photoconductive compositions to be incorporated in an element on the photoconductive sensitivity, photoconductivity retention and thermal erasure capability of the resulting photoconductive element.

As a result, it has been found, quite surprisingly, that a photoconductive element comprising a specific polymer layer superimposed on a specific pigment layer can solve the above-noted problems. Based on this finding, we have completed this invention.

It is, therefore, an object of the present invention to provide a novel persistent photoconductive element, (1) which is suitably employed in the above-described method of reproduction utilizing the property of a photoconductive element which upon a single image-wise exposure, permits an electrical image to be generated and persist over a period of time sufficient to produce a plurality of image copies (hence, different from the conventional Carlson system in which corona charging, exposure, development and image transfer are repeated), (2) on which an image can be formed with a quantity of exposure light equal to or smaller than that required in the conventional copying machine of the Carlson system and which enables an increased number of copies to be obtained at a higher speed than in the conventional technique, (3) and in which the once-formed persistent photoconductivity can be erased by carrying out a heat treatment at an appropriate temperature and a persistent photoconductivity is produced again by exposure to light.

The foregoing and other objects, features and advantages of the present invention will be apparent to those skilled in the art from the following detailed description and appended claims.

According to the present invention, there is provided a persistent photoconductive element comprising an electroconductive support, a pigment layer formed on said support and composed mainly of a phthalocyanine pigment or Indanthrene Blue GCD of the formula:

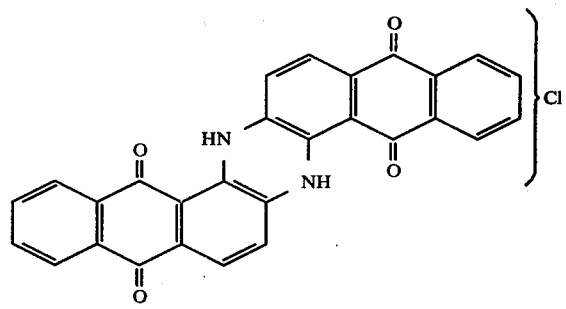

and a polymer layer formed on said pigment layer and composed mainly of a polyvinyl carbazole, said polymer layer containing at least one member selected from the group consisting of aliphatic halogenated hydrocarbons, halogenated acyl compounds, halogenated keto compounds and hydrogen donor compounds.

According to the present invention, there is also provided a persistent photoconductive element comprising an electroconductive support, a pigment layer formed on said support and composed mainly of a phthalocyanine pigment or Indanthrene Blue GCD of the formula:

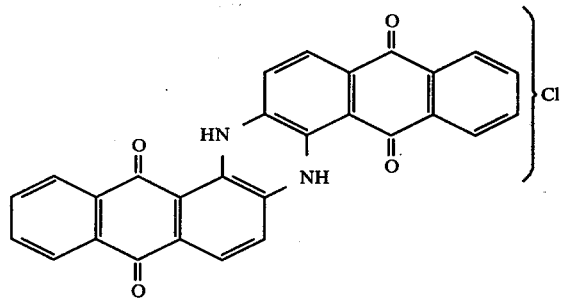

and a polymer layer formed on said pigment layer and composed mainly of a polyvinyl carbazole, said polymer layer containing a dye and at least one member selected from aliphatic halogenated hydrocarbons, halogenated acyl compounds, halogenated keto compounds and hydrogen donor compounds.

The basic structure of the persistent photoconductive element of the present invention comprises an electroconductive support, a pigment layer formed on the electroconductive support and a polymer layer formed on the pigment layer. The pigment layer is composed mainly of a phthalocyanine pigment or Indanthrene Blue GCD, and a binder resin may be incorporated in the pigment layer. The polymer layer is composed mainly of poly-N-vinylcarbazole and contains at least one member selected from the group consisting of aliphatic halogenated hydrocarbons, halogenated acyl compounds, halogenated keto compounds and hydrogen donor compounds. A specific dye may be added to the polymer layer when it is desired to enhance the sensitivity of the photoconductive element to rays in the visible ray range. Furthermore, a specific plasticizer and/or a specific resin may be incorporated in the polymer layer so as to improve the flexibility and mechanical durability of the photoconductive element.

As described above, the persistent photoconductive element of the present invention has a pigment layer and a polymer layer. The polymer layer as defined above alone shows a certain degree of persistent photoconductivity. However, it has been found, quite surprisingly, that the polymer layer, if combined with a pigment layer comprising a specific pigment, that is, a phthalocyanine pigment or Indanthrene Blue GCD, exhibits a synergistically improved persistent photoconductivity. The mechanism of the persistent photoconductivity in the present invention has not sufficiently been elucidated, but it is apparent that the persistent photoconductivity is due to the synergistic effect of the polymer layer and pigment layer in the present invention. Accordingly, the mechanism working in the present invention is apparently different from the mechanism of the conventional technique disclosed in U.S. Pat. No. 3,997,342 in which the polymer layer alone does not show any persistent photoconductivity and the persistent photoconductivity is due to the special charge-generation layer. More specifically, in the photoconductive element of the present invention, the polymer layer not only exerts a function as the charge-transport layer but also is considered to exert some function as the charge-generation layer in combination with the function as the charge-transport layer because it shows a persistent photoconductivity on exposure to light. Moreover, it is believed that the pigment layer exerts a function more than the function of the conventional charge-generation layer in which only charge generation is performed by exposure to light. Therefore, a very high persistent photoconductive sensitivity can be attained according to the present invention by the synergistic effect of the polymer layer and the pigment layer. Accordingly, the photoconductive element of the present invention comprises two layers apparently different from those of the conventional photoconductive element in which the two layers are clearly separated by the functions thereof as the charge-generation layer and charge-transport layer. Therefore, in the present invention, the above-mentioned two layers will be referred to as "pigment layer" and "polymer layer", respectively, hereinafter.

The present invention will now be described in detail.

As the electroconductive support employed in the present invention, there can be mentioned sheets of metals such as aluminum and nickel, metal-vacuum-deposited films and paper sheets which have been subjected to electroconductive treatment.

In the present invention, a pigment layer is formed on the electroconductive support. As the pigment that is used in the present invention, there can be mentioned phthalocyanine pigments, for example, metal-free phthalocyanine, metal phthalocyanines such as magnesium phthalocyanine, lead phthalocyanine, vanadium phthalocyanine, chromium phthalocyanine, aluminum phthalocyanine, iron phthalocyanine, cobalt phthalocyanine and nickel phthalocyanine, and halogenated and sulfonated phthalocyanine derivatives. The crystal form of the phthalocyanine pigment is not particularly critical, but any of the $\alpha$-type, $\beta$-type, $\gamma$-type, $\delta$-type, $\epsilon$-type, $\chi$-type, $\pi$-type, $\rho$-type and x-type crystal forms may be adopted. Among these phthalocyanines, $\alpha$-metal-free-phthalocyanine is especially preferred, though a phthalocyanine pigment that can be used in the present invention is not limited to $\alpha$-metal-free-phthalocyanine.

Also Indanthrene Blue GCD having the following structure may preferably be used for formation of the pigment layer:

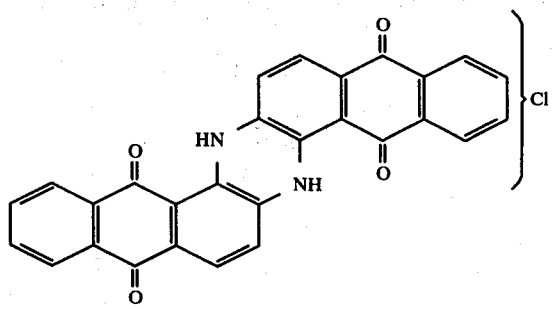

It is preferred that the thickness of the pigment layer be 0.01 to 10 microns. If the thickness is smaller than 0.01 micron, the persistent conductivity tends to decrease, and if the thickness is larger than 10 microns, fogging becomes vigorous. This pigment layer may be formed by vacuum deposition or by a method in which a dispersion of a pigment in a solvent is coated on the substrate and the solvent is evaporated.

In the present invention, the intended layer structure may be formed by coating a polymer layer on the pigment layer composed solely of a pigment as mentioned above. However, in the present invention, a binder resin may be incorporated in the pigment layer so as to improve the adhesion between the electroconductive substrate and the pigment layer. The binder resin to be used in the present invention should have such properties that the sensitivity of the persistent photoconductive element is not reduced by incorporation of the binder resin in the pigment layer and its adhesion strength to the support is high. As a result of the researches made by us, it has been found that polyvinyl butyral, a terpolymer of vinyl chloride/vinyl acetate/maleic acid and polyvinyl pyrrolidone are especially preferred as the binder resin.

It is preferred that the binder resin be used in an amount of 5 to 200 parts by weight per 100 parts by weight of the pigment. If the amount of the binder resin is smaller than 5 parts by weight, the bonding effect is low, and if the amount of the binder resin is 200 parts by weight, the photoconductive sensitivity of the element is reduced. It is especially preferred that the amount of the binder resin be in the range of 30 to 100 parts by weight per 100 parts by weight of the pigment. The pigment layer may be formed by coating and drying a dispersion of the pigment and binder in a solvent.

In the present invention, a layer of polyvinyl carbazole is formed on the above-noted pigment layer. It is essential to incorporate into the polyvinyl carbazole layer at least one member selected from the group consisting of aliphatic halogenated hydrocarbons, halogenated acyl compounds, halogenated keto compounds and hydrogen donor compounds, preferably in an amount of 0.01 to 10 parts by weight per 100 parts by weight of polyvinyl carbazole. To incorporate the above compound into polyvinyl carbazole, there may be adopted a method in which the above compound is added when a solution of polyvinyl carbazole is prepared and the resulting homogeneous solution or suspension is coated on the substrate and dried.

The thickness of this polyvinyl carbazole layer is 1 to 30 microns, preferably 2 to 20 microns. If the thickness of the polyvinyl carbazole layer is smaller than 1 micron, the contrast of the image is insufficient, and if the thickness of the polyvinyl carbazole layer is larger than 30 microns, the resolving power of the resulting photoconductive element is reduced.

As the suitable aliphatic halogenated hydrocarbon, there may be used carbon tetrachloride, trichloroethane, carbon tetrabromide, chloroform, hexachloropropane, trichloroethylene, tetrachloroethylene, dichlorodibromoethane, polyvinyl chloride and polyvinylidene chloride.

As the suitable halogenated keto compound, there may be used chloroacetone, bromoacetone, bromoacetophenone and tribromoacetophenone.

As the suitable halogenated acyl compound, there may be used acetyl chloride, acetyl bromide, chloroacetyl chloride, dichloroacetyl chloride, bromoacetyl bromide and chlorobenzoyl chloride.

Organic and inorganic acids are used as the suitable hydrogen donor compound. As the organic acid, there can be mentioned acetic acid, dichloroacetic acid, trichloroacetic acid, benzoic acid, dinitrobenzoic acid, phthalic acid, tetrabromophthalic acid, maleic acid, phenol, nitrophenol, picric acid, phthalic anhydride, maleic anhydride and brominated maleic anhydride. As the inorganic acid, there can be mentioned hydrochloric acid, sulfuric acid, phosphoric acid and boric acid.

In order to improve the sensitivity of the persistent photoconductive element to rays in the white light range, a dye is incorporated in the polyvinyl carbazole layer. In an ordinary photosensitive element which is not a persistent photoconductive element, a sensitizing dye is incorporated so as to improve the half-value light exposure sensitivity. In the novel persistent photoconductive element of the present invention comprising the pigment layer and the polymer layer (composed mainly of polyvinyl carbazole) containing the above-mentioned specific additive, incorporation of a dye into the polyvinyl carbazole layer contributes to improving the sensitivity of the persistent photoconductive element (that is, a persistent photoconductivity is observed with weaker radiation and this photoconductivity is maintained for a longer time and the surface potential-receiving property of the irradiated portion of the photoconductive element is reduced). This is quite a surprising effect, although the mechanism of this effect has not completely been elucidated.

As the dye that is used in the present invention, there can be mentioned triphenylmethane dyes such as Brilliant Green, Methyl Violet, Malachite Green, Victoria Blue, and Crystal Violet, rhodamine dyes such as Rhodamine B and Rhodamine 6G, xanthene dyes such as Eosine S and Erythrocin, thiazine dyes such as Methylene Blue, acridine dyes such as Acridine Yellow and Trypaflavin, quinoline dyes such as Pinacyanol and Cryptocyanine, ketone dyes such as Alizarine and Quinizarin, allylmethane dyes such as Violet Fuchsine and Rhodamine B-500, cyanine dyes, polymethine dyes, azo dyes, azomethine dyes, carbonyl dyes, benzopyrylium dyes, and 3,3'-di-(N-ethylcarbazoyl)-phenylmethyl iodide.

Of the above dyes, Crystal Violet, Malachite Green, Rhodamine 6G, Victoria Blue, Rhodamine B and 3,3'-di-(N-ethylcarbazoyl)-phenylmethyl iodide are especially preferred.

In order to improve the flexibility and mechanical strength of the polymer layer, a specific plasticizer and/or a specific resin may be incorporated into the polymer layer.

Plasticizers customarily used for polyvinyl carbazole may be used. However, when these known plasticizers are incorporated in the polyvinyl carbazole layer, the sensitivity of the photoconductive element is occasionally drastically reduced. It has been found, however, that specific plasticizers, i.e. chlorinated n-paraffin, $\beta$-methylnaphthalene and biphenyl, can be incorporated in the polymer layer without causing such reduction of the sensitivity of the persistent photoconductive element.

The specific resin to be employed is also required not to cause reduction of the sensitivity of the persistent photoconductive element. As such specific resins, there can be mentioned a polyvinyl chloride resin, a polyvinylidene chloride resin, a terpolymer resin of vinyl chloride/vinyl acetate/maleic acid, a silicone resin and a xylene resin.

It is preferred that the specific plasticizer be incorporated in an amount of 0.1 to 20 parts by weight per 100 parts by weight of polyvinyl carbazole, and that the specific resin be incorporated in an amount of 0.1 to 20 parts by weight per 100 parts by weight of polyvinyl carbazole. When both the plasticizer and the resin are simultaneously incorporated, it is preferred that the total amount of the two components be 0.2 to 20 parts by weight per 100 parts by weight of the polyvinyl carbazole. If the added amount of the additive is too small and below the above range, the effect of improving the flexibility and mechanical strength of the polymer layer is not sufficient, and if the added amount of the additive is too large and exceeds the above range, the sensitivity of the persistent photoconductive element is reduced.

According to need, a layer of a protective polymer having a thickness of 1 to 2 microns may be formed on the polymer layer so as to improve the abrasion resistance and chemical deterioration resistance of the photoconductive element. Moreover, if desired, a blocking layer, such as a thin anodized film or a thin insulating layer of a polymer, e.g. polyamide, may be formed between the pigment layer and the electroconductive support. Furthermore, there may be incorporated into the pigment layer at least one member selected from the group consisting of aliphatic halogenated hydrocarbons, halogenated acyl compounds, halogenated keto compounds and hydrogen donor compounds.

The persistent photoconductive element of the present invention which comprises an electroconductive support and, superimposed thereon, a specific pigment layer and a specific polymer layer as defined above and in the appended claims exhibits a remarkably improved photoconductive sensitivity over the photoconductive element in which a polymer layer is directly superimposed on an electroconductive support without providing an intermediate pigment layer.

The combination of a specific pigment layer and a specific polymer layer according to the present invention brings about a synergistic improvement of photoconductive sensitivity and photoconductivity duration, although the mechanism of the persistent photoconductivity in the present invention has not sufficiently been elucidated. From the fact that the persistent photoconductivity in the present invention is due to the synergistic effect of the polymer layer and the pigment layer, the mechanism working in the present invention is apparently different from the mechanism of the conventional technique in which the charge transport layer does not inherently contribute to persistent photoconductivity and the persistent photoconductivity is solely due to the charge generation layer.

Further, for the purpose of improving the flexibility and mechanical duration of the persistent photoconductive element, without adversely affecting the photoconductive sensitivity thereof, a binding resin and a plasticizer and/or resin may be incorporated in the pigment layer and polymer layer, respectively, of the persistent photoconductive element of the present invention.

The present invention will be illustrated in more detail with reference to the following Examples, which should not be construed to be limiting the scope of the present invention.

In the following Examples and Comparative Examples, the photoconductive and mechanical properties of persistent photoconductive elements were determined according to the following methods.

1. Persistent Photoconductive Sensitivity

The Persistent Photoconductive Sensitivity as used herein is defined as the quantity of light exposure (lux·sec) necessary for obtaining a surface voltage recovery ratio of 0.5 (the ratio of the surface voltage obtained after the corona discharging was repeated 100 times upon light exposure relative to the initial surface charge voltage at the time of the electro-charging in the non-exposed state after heating at 150° C. for 5 seconds).

Actually, the above-defined sensitivity of the photoconductive element was determined as follows:

(1) The photoconductive element was heated at 150° C. for 5 seconds and was then subjected to negative charging at a corona charging voltage of −5.5 KV for 0.25 second by using an electrostatic paper analyzer (Model SP-428 manufactured and sold by Kawaguchi Electric Co., Ltd., Japan), and the surface voltage before the light exposure was measured.

(2) Then, the photoconductive element was heated at 150° C. for 5 sedonds again and was subjected to predetermined light exposure by using a tungusten lamp (having a color temperature of 2856° K.) attached to the apparatus. The illuminance of the light source was measured by an illuminometer attached to the apparatus. The predetermined quantity of white light was obtained by changing the exposure time at a certain illuminance.

(3) After the light exposure, the corona charging was carried out in the same manner as described above and the surface voltage after the light exposure was measured.

(4) Then, the above-mentioned corona charging and measurement of the surface voltage were repeated 100 times without undergoing the light exposure. The recovery of the surface voltage by the repetition of the corona discharge was measured to evaluate the above-defined sensitivity of the photoconductive element.

2. Flexibility

The Flexibility of the persistent photoconductive element was measured by subjecting the element to a bending test using a bending tester manufactured and sold by Toyo Seiki K. K., Japan. In the bending test, a rod having a specific diameter of, for example, 8 mm (8$\phi$) or 10 mm (10$\phi$), is placed on a test specimen. Then, the test specimen is bended over the surface of the rod until cracking of the test specimen occurs.

The flexibility is evaluated as the bending angle causing cracking with respect to the diameter of the rod used for the bending test.

3. Adhesion

The Adhesion between the polymer layer and the electroconductive support was visually evaluated with the manual aid.

Example 1

In 100 ml of dichloroethane as a solvent, 2 g of $\alpha$-metal-free-phthalocyanine was homogeneously dispersed by ultrasonic vibration, and the dispersion was applied onto an aluminum sheet (having a thickness of 100 microns) which had been surface-roughened by a sand paper of #800, by means of an applicator, to form an $\alpha$-metal-free-phthalocyanine layer having a thickness of 1 to 2 microns. Then, a mixture obtained by dissolving 10 g of polyvinyl carbazole, 900 mg of dichloroacetic acid and 10 mg of Crystal Violet in 100 ml of tetrahydrofuran (THF) was coated on the $\alpha$-metal-free-phthalocyanine layer by means of an applicator having a slit width of 200 microns and allowed to be dried in the dark overnight, to form a polyvinyl carbazole layer having a thickness of 15 microns. The resulting photoconductive element was heat-treated at 150° C. for 1 hour in a drying apparatus to obtain a persistent photoconductive element. The sensitivity of the persistent photoconductive element prepared in this Example was 400 lux·sec.

Comparative Example 1

A persistent photoconductive element comprising a polymer layer alone with no pigment layer was prepared in the same manner as described in Example 1 except that the $\alpha$-metal-free phthalocyanine layer was not formed. The sensitivity of the resulting persistent photoconductive element was 3200 lux·sec.

It is readily understood that incorporation of a pigment layer as in Example 1, brings about synergistic improvement of the sensitivity of the photoconductive element.

Example 2

A persistent photoconductive element was prepared in the same manner as described in Example 1 except that 5 mg of Malachite Green was used instead of 10 mg of Crystal Violet. The sensitivity of the resulting persistent photoconductive element was 800 lux·sec.

Comparative Example 2

A persistent photoconductive element comprising a polymer layer alone was prepared in the same manner as described in Example 2 except that the $\alpha$-metal-free-phthalocyanine layer was not formed. The sensitivity of the resulting persistent photoconductive element was 4000 lux·sec.

Example 3

A series of persistent photoconductive elements were prepared in the same manner as described in Example 1 except that 5 mg of Rhodamine 6G, 5 mg of Victoria Blue and 5 mg of Rhodamine B were respectively used, instead of 10 mg of Crystal Violet. The sensitivities of the persistent photoconductive elements were 800 lux·sec for Rhodamine 6G, 500 lux·sec for Victoria Blue, and 1250 lux·sec for Rhodamine B.

Comparative Example 3

A series of persistent photoconductive elements each comprising a polymer layer alone were prepared in the same manner as described in Example 3 except that the α-metal-free-phthalocyanine layer was not formed. The sensitivities of the persistent photoconductive elements were 4000 lux·sec for Rhodamine 6G, 4300 lux·sec for Victoria Blue, and 6000 lux·sec for Rhodamine B.

Example 4

A persistent photoconductive element was prepared in the same manner as described in Example 1 except that 100 mg of 3,3'-di-(N-ethylcarbazoyl)-phenylmethyl iodide having the following formula:

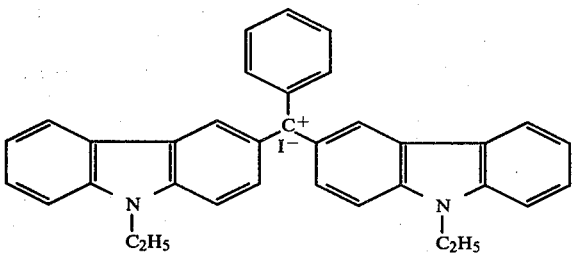

was used instead of 10 mg of Crystal Violet. The sensitivity of the persistent photoconductive element was 100 lux·sec.

Comparative Example 4

A persistent photoconductive element comprising a polymer layer alone was prepared in the same manner as described in Example 4 except that the α-metal-free-phthalocyanine layer was not formed. The sensitivity of the persistent photoconductive element was 500 lux·sec.

Example 5

A dye-free persistent photoconductive element was prepared in the same manner as described in Example 1 except that Crystal Violet was not used. The sensitivity of the persistent photoconductive element was 3000 lux·sec.

Comparative Example 5

A persistent photoconductive element comprising a polymer layer alone was prepared in the same manner as described in Example 5 except that the α-metal-free-phthalocyanine layer was not formed. The sensitivity of the persistent photoconductive element was 15000 lux·sec.

Example 6

A persistent photoconductive element was prepared in the same manner as described in Example 4 except that dinitrobenzoic acid was used instead of dichloroacetic acid. The sensitivity of the persistent photoconductive element was 30 lux·sec.

Comparative Example 6

A persistent photoconductive element comprising a polymer layer alone was prepared in the same manner as described in Example 6 except that the α-metal-free-phthalocyanine layer was not formed. The sensitivity of the persistent photoconductive element was 150 lux·sec.

Example 7

In 100 ml of dichloroethane as a solvent, 2 g of α-metal-free-phthalocyanine was homogeneously dispersed by ultrasonic vibration, and the dispersion was applied onto an aluminum sheet (having a thickness of 100 microns) which had been surface-roughened by a sand paper of #800, by means of an applicator, to form an α-metal-free-phthalocyanine layer having a thickness of 1 to 2 microns. A mixture obtained by dissolving 60 mg of trichloroacetic acid in 100 g of a 10% solution of polyvinyl carbazole in 1,1,2,2-tetra-chloroethane as a solvent was coated on the α-metal-free-phthalocyanine layer by means of an applicator and was allowed to dry in the dark overnight to form a polyvinyl carbazole layer having a thickness of 10 microns. The resulting photoconductive element was heat-treated at 150° C. for 1 hour in a drying apparatus to obtain a persistent photoconductive element. The sensitivity of the resulting persistent photoconductive element was 3500 lux·sec.

Comparative Example 7

A persistent photoconductive element comprising a polymer layer alone was prepared in the same manner as described in Example 7 except that the α-metal-free-phthalocyanine layer was not formed. The sensitivity of the persistent photoconductive element was 17000 lux·sec.

Example 8

Persistent photoconductive elements were prepared in the same manner as described in Example 7 except that carbon tetrabromide and hexachloroacetone were respectively used instead of trichloroacetic acid. The sensitivities of the persistent photoconductive elements were 4000 lux·sec for carbon tetrabromide and 4300 lux·sec for hexachloroacetone.

Comparative Example 8

Persistent photoconductive elements each comprising a polymer layer alone were prepared in the same manner as described in Example 8 except that the α-metal-free-phthalocyanine layer was not formed. The sensitivities of the persistent photoconductive elements were 18000 lux·sec for carbon tetrabromide, and 18500 lux·sec for hexachloroacetone.

Example 9

A series of persistent photoconductive elements were prepared in the same manner as described in Example 1 except that α-copper-phthalocyanine, ε-copper-phthalocyanine, monochloro-α-copper-phthalocyanine, β-copper-phthalocyanine, monochloro-aluminum-phthalocyanine chloride and Indanthrene Blue GCD were respectively used instead of α-metal-free-phthalocyanine. The sensitivities of the resulting persistent photoconductive elements were 450 lux·sec for α-copper-phthalocyanine, 500 lux·sec for ε-copper-phthalocyanine, 530 lux·sec for monochloro-α-copper-phthalocyanine, 550 lux·sec for β-copper-phthalocyanine, 500 lux·sec for monochloro-aluminum-phthalocyanine chloride, and 410 lux·sec for Indanthrene Blue GCD.

Comparative Example 9

A series of persistent photoconductive elements were prepared in the same manner as described in Example 1 except that Chlorodiane Blue, Perylimid and indigo pigments (Color Index Number 73360, 73335 and 73015) were respectively used instead of α-metal-free-phthalocyanine. For all the pigments, the sensitivities of the persistent photoconductive elements were larger than 50000 lux·sec. It is noted that when the above pigments were used, the sensitivities of the persistent photoconductive elements were much lower than that of the comparative persistent photoconductive element with no pigment layer (Comparative Example 1), which was 3200 lux·sec.

Example 10

A persistent photoconductive element comprising the pigment and polymer layers both containing an organic acid was prepared in the same manner as described in Example 1 except that 100 mg of dichloroacetic acid was added in preparing the α-metal-free-phthalocyanine layer. The sensitivity of the resulting persistent photoconductive element was 420 lux·sec.

Example 11

In 100 ml of dichloroethane as a solvent, 2 g of α-metal-free-phthalocyanine was homogeneously dispersed by ultrasonic vibration, and the dispersion was applied onto an aluminum sheet (having a thickness of 100 microns), which had been surface-roughened by a sand paper of #800, by means of an applicator to form an α-metal-free-phthalocyanine layer having a thickness of 1 to 2 microns. Then, a mixture obtained by dissolving 10 g of polyvinyl carbazole, 900 mg of dichloroacetic acid and 1 g of biphenyl as a plasticizer in 100 ml of tetrahydrofuran (THF) was coated on the α-metal-free-phthalocyanine layer by means of an applicator having a slit width of 200 microns and was allowed to dry in the dark to form a polyvinyl carbazole layer having a thickness of 15 microns. The resulting photoconductive element was heat-treated at 150° C. for 1 hour in a drying apparatus to obtain a persistent photoconductive element.

A plasticizer-free persistent photoconductive element was prepared in the same manner as described above except that the plasticizer was not added.

The photoconductive elements were tested by the bending tester. No cracking occurred on the biphenyl-added photoconductive element even with a rod of 6ϕ. In contrast, on the plasticizer-free photoconductive element, cracking occurred at 70° with a rod of 10ϕ.

The sensitivity of the biphenyl-incorporated photoconductive element was 3100 lux·sec and that of the plasticizer-free photoconductive element was 3000 lux·sec. It was confirmed that the photoconductive sensitivity was not degraded by incorporation of the plasticizer.

Example 12

Persistent photoconductive elements were prepared in the same manner as described in Example 11 except that chlorinated paraffin and β-methylnaphthalene were respectively used as the plasticizer instead of biphenyl. In the bending test, cracking occurred at 120° with 10ϕ for chlorinated n-paraffin and at 120° with 8ϕ for β-methylnaphthalene. The sensitivities of the persistent photoconductive elements were 3400 lux-sec for chlorinated n-paraffin and 3100 lux-sec for β-methylnaphthalene.

Comparative Example 10

A series of persistent photoconductive elements were prepared in the same manner as described in Example 11 except that triphenyl phosphate, o-terphenyl and di-n-butyl phthalate were respectively used as the plasticizer instead of biphenyl. In the bending test, cracking occurred at 180° with 8ϕ for triphenyl phosphate, at 105° with 10ϕ for o-terphenyl, and at 90° with 8ϕ for di-n-butyl phthalate. The sensitivities of the persistent photoconductive elements were 30000 lux·sec for triphenyl phosphate, 25000 lux·sec for o-terphenyl and 33000 lux·sec for di-n-butyl phthalate. From these results, it is seen that the mechanical property is improved to some extent by the above plasticizers, but the sensitivity of the persistent photoconductive element is degraded by such plasticizers.

Example 13

A persistent photoconductive element was prepared in the same manner as described in Example 11 except that a terpolymer resin of vinyl chloride/vinyl acetate/maleic acid ("Eslec M" produced and sold by Sekisui Chemical Co., Ltd., Japan) was used instead of biphenyl. In the bending test, cracking occurred at 180° with 10ϕ. The sensitivity of the persistent photoconductive element was 3000 lux·sec.

Example 14

A series of persistent photoconductive elements were preprepared in the same manner as described in Example 13 except that a polyvinyl chloride resin, a polyvinylidene chloride resin, a silicone resin and a xylene resin were respectively used instead of the terpolymer resin of vinyl chloride/vinyl acetate/maleic acid. In the bending test, cracking occurred at 180° with 10ϕ for the polyvinyl chloride resin, at 180° with 10ϕ for the polyvinylidene chloride resin, at 90° with 10ϕ for the silicone resin, and at 120° with 10ϕ for the xylene resin. The sensitivities of the persistent photoconductive elements were 2800 lux·sec for the polyvinyl chloride resin, 2900 lux·sec for the polyvinylidene chloride resin, 3100 lux·sec for the silicone resin and 3500 lux·sec for the xylene resin.

Comparative Example 11

A series of persistent photoconductive elements were prepared in the same manner as described in Example 13 except that polycarbonate, a ketone resin and polyvinyl butyral were respectively used instead of the terpolymer resin of vinyl chloride/vinyl acetate/maleic acid. In the bending test, cracking occurred at 80° with 10ϕ for the polycarbonate, at 100° with 10ϕ for the ketone resin and at 120° with 8ϕ for the polyvinyl butyral. The sensitivities of the persistent photoconductive elements were 30000 lux·sec for the polycarbonate, 35000 lux·sec for the ketone resin and 40000 lux·sec for the polyvinyl butyral. It is seen that the sensitivity of the element drastically drops with the above plasticizers.

Example 15

Persistent photoconductive elements were prepared in the same manner as described in Example 11 except that 0.5 g of biphenyl plus 0.5 g of a vinyl chloride resin and 0.5 g of biphenyl plus 0.5 g of a terpolymer resin of vinyl chloride/vinyl acetate/maleic acid were respectively used as the plasticizer. In the bending test, cracking occurred at 90° with 8ϕ for the biphenyl plus the vinyl chloride resin and at 130° with 8ϕ for the biphenyl plus the terpolymer resin of vinyl chloride/vinyl acetate/maleic acid. The sensitivities of the persistent photoconductive elements were 3100 lux·sec for the biphenyl plus the vinyl chloride resin, and 3000 lux·sec for the biphenyl plus the terpolymer resin of vinyl chloride/vinyl acetate/maleic acid.

Example 16

In 100 ml of chloroform as a solvent, 2 g of α-metal-free-phthalocyanine and 2 g of a terpolymer resin of vinyl chloride/vinyl acetate/maleic acid ("Eslec M" produced and sold by Sekisui Chemical Co., Ltd., Japan) as a binder resin were homogeneously dispersed by ultrasonic vibration, and the dispersion was applied onto an aluminum sheet (having a thickness of 100 microns) which was not surface-roughened but had a mirror surface, by means of an applicator, to form an α-metal-free-phthalocyanine layer having a thickness of 1 to 2 microns. The coating was allowed to dry in the dark for 5 hours and heat-treated at 150° C. for 20 minutes in a drying apparatus. Then, a mixture obtained by dissolving 10 g of polyvinyl carbazole and 900 mg of dichloroacetic acid in 100 ml of tetrahydrofuran (THF) was coated on the α-metal-free-phthalocyanine layer by means of an applicator having a slit width of 200 microns and was allowed to dry overnight in the dark to form a polyvinyl carbazole layer having a thickness of 15 microns. The resulting photoconductive element was heat-treated at 150° C. for 1 hour in a drying apparatus to obtain a persistent photoconductive element. A binder resin-free persistent photoconductive element was prepared in the same manner as described above except that the binder resin was not used in forming the phthalocyanine layer. Furthermore, a binder resin-free persistent photoconductive element formed on a surface-roughened aluminum sheet was prepared in the same manner as described above except that in forming the phthalocyanine layer, the binder resin was not used and an aluminum sheet which had been surface-roughened by a sand paper of #800 was used instead of the aluminum sheet having a mirror surface.

The bending test was carried out. On the binder resin-incorporated photoconductive element formed on the mirror surface aluminum sheet, cracking occurred at 60° with 10ϕ. With respect to the binder resin-free photoconductive element formed on the mirror surface aluminum sheet, after drying, the polymer layer was peeled off from the support. On the binder resin-free photoconductive element formed on the surface-roughened aluminum sheet, cracking occurred at 70° with 10ϕ.

The sensitivity of the binder resin-incorporated photoconductive element formed on the mirror surface aluminum sheet was 3100 lux·sec. The sensitivity of the binder resin-free photoconductive element formed on the mirror surface aluminum sheet was impossible to measure because of peeling-off. The sensitivity of the binder resin-free photoconductive element formed on the surface-roughened aluminum sheet was 3000 lux·sec. Thus, it was confirmed that the sensitivity of the persistent photoconductive element was not degraded by incorporation of the binder resin used in this Example.

Example 17

A persistent photoconductive element was prepared in the same manner as described in Example 16 except that dinitrobenzoic acid was used instead of dichloroacetic acid. In the bending test, cracking occurred at 60° with 10ϕ. The sensitivity of the persistent photoconductive element was 300 lux·sec.

Example 18

Persistent photoconductive elements were prepared in the same manner as described in Example 16 except that polyvinyl pyrrolidone and polyvinyl butyral were respectively used as the binder resin instead of the terpolymer resin of vinyl chloride/vinyl acetate/maleic acid. In the bending test, cracking occurred at 60° with 10ϕ for the polyvinyl pyrrolidone, and at 70° with 10ϕ for the polyvinyl butyral. The sensitivities of the persistent photoconductive element were 3300 lux·sec for the polyvinyl pyrrolidone, and 3300 lux·sec for the polyvinyl butyral.

Comparative Example 12

A series of persistent photoconductive elements were prepared in the same manner as described in Example 16 except that 2 g of polybutyl methacrylate, polyamide and polyvinyl acetate were respectively used as the binder resin. In the bending test, cracking occurred at 60° with 10ϕ for the polybutyl methacrylate, at 70° with 10ϕ for the polyamide, and at 70° with 10ϕ for the polyvinyl acetate. The sensitivities of the persistent photoconductive elements were 11000 lux·sec for the polybutyl methacrylate, 9000 lux·sec for the polyamide, and 11000 lux·sec for the polyvinyl acetate.

Example 19

A persistent photoconductive element was prepared in the same manner as described in Example 16 except that 0.5 g of biphenyl as plasticizer and 0.5 g of a terpolymer resin of vinyl chloride/vinyl acetate/maleic acid as an additive resin were further incorporated in the polyvinyl carbazole layer. In the bending test, cracking occurred at 180° with 8ϕ. The sensitivity of the persistent photoconductive element was 3100 lux·sec. In the case where the composition of the polyvinyl carbazole layer was the same as described above but the binder resin was not incorporated in the phthalocyanine layer, cracking occurred at 120° with 10ϕ, and the sensitivity of the persistent photoconductive element was 3000 lux·sec.

Example 20

In 100 ml of dichloroethane as a solvent, 2 g of α-metal-free phthalocyanine was homogeneously dispersed by ultrasonic vibration, and the dispersion was applied onto an aluminum sheet (having a thickness of 100 microns), which had been surface-roughened by a sand paper of #800, by means of an applicator, to form an α-metal-free-phthalocyanine layer having a thickness of 1 to 2 microns. Then, a mixture obtained by dissolving 10 g of polyvinyl carbazole, 900 mg of dichloroacetic acid, 1 g of biphenyl as a plasticizer and 100 mg of 3,3'-(N-ethylcarbazoyl)phenylmethyl iodide of the formula:

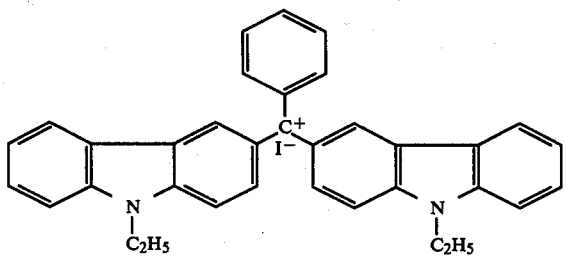

as a dye in 100 ml of tetrahydrofuran (THF) was coated on the phthalocyanine layer by means of an applicator having a slit width of 200 microns and was allowed to dry overnight in the dark to obtain a polyvinyl carbazole layer having a thickness of 15 microns. The resulting photoconductive element was heat-treated at 150° C. for 1 hour in a drying apparatus to obtain a persistent photoconductive element. The above procedures were repeated using 10 mg of Crystal Violet instead of 100 mg of 3,3'-(N-ethylcarbazoyl)phenylmethyl iodide to prepare a persistent photoconductive element.

In the bending test, cracking occurred at 180° with 6ϕ for the Crystal Violet, and also for the 3,3'-di-(N-ethylcarbazoyl)phenylmethyl iodide. The sensitivities of the persistent photoconductive elements were 450 lux·sec for the Crystal Violet, and 130 lux·sec for the 3,3'-(N-ethylcarbazoyl)phenylmethyl iodide.

Plasticizer-free persistent photoconductive elements were prepared in the same manner as described above except that biphenyl was not used as the plasticizer. In the bending test, cracking occurred at 70° with 10ϕ for the Crystal Violet, and also for the 3,3'-di-(N-ethylcarbazoyl)phenylmethyl iodide. The sensitivities of the persistent photoconductive elements were 400 lux·sec for the Crystal Violet, and 100 lux·sec for the 3,3'-di-(N-ethylcarbazoyl)phenylmethyl iodide.

From the foregoing result, it is seen that the flexibility and mechanical strength were improved by the plasticizer used in this Example, without significantly lowering the sensitivity.

Example 21

A persistent photoconductive element was prepared in the same manner as described in Example 20 except that 0.5 g of biphenyl plus 0.5 g of a polyvinyl chloride resin was used as the plasticizer and 100 mg of 3,3'-di-(N-ethylcarbazoyl)phenylmethyl iodide was used as the dye. The above procedures were repeated using a terpolymer resin of vinyl chloride/vinyl acetate/maleic acid instead of the polyvinyl chloride resin to prepare a persistent photoconductive element. In the bending test, cracking occurred at 90° with 8ϕ for the biphenyl plus the vinyl chloride resin, and at 130° with 8ϕ for the biphenyl plus the terpolymer resin of vinyl chloride/vinyl acetate/maleic acid. The sensitivities of the persistent photoconductive elements were 110 lux·sec in either case.

Example 22

In 100 ml of chloroform, 2 g of α-metal-free-phthalocyanine and 2 g of a terpolymer resin of vinyl chloride/vinyl acetate/maleic acid ("Eslec M" produced and sold by Sekisui Chemical Co., Ltd., Japan) were homogeneously dispersed by ultrasonic vibration, and the dispersion was applied onto an aluminum sheet (having a thickness of 100 microns) which was not surface-roughened but had a mirror surface, by means of an applicator, to form an α-metal-free-phthalocyanine layer having a thickness of 1 to 2 microns. The coating was allowed to dry in the dark for 5 hours and heat-treated at 150° C. for 20 minutes in a drying apparatus. Then, a mixture obtained by dissolving 10 g of polyvinyl carbazole, 900 mg of dichloroacetic acid and 100 mg of 3,3'-di-(N-ethylcarbazoyl)phenylmethyl iodide of the formula:

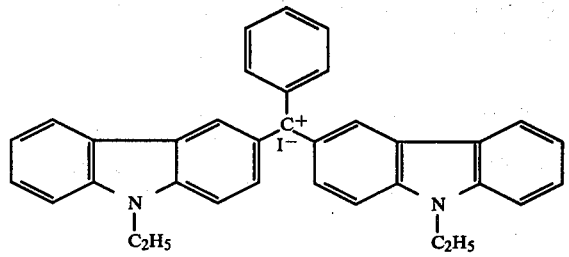

as a dye in 100 ml of THF was coated on the α-metal-free-phthalocyanine layer by means of an applicator having a slit width of 200 microns and was allowed to dry overnight in the dark to form a polyvinyl carbazole layer having a thickness of 15 microns. The resulting photoconductive element was heat-treated at 150° C. for 1 hour in a drying apparatus to obtain a persistent photoconductive element. The above procedures were repeated using 10 mg of Crystal Violet instead of 100 mg of 3,3'-di-(N-ethylcarbazoyl)phenylmethyl iodide to prepare a persistent photoconductive element. In the bending test, cracking occurred at 60° with 10ϕ for the Crystal Violet, and also for the 3,3'-di-(N-ethylcarbazoyl)phenylmethyl iodide. The sensitivities of the persistent photoconductive elements were 420 lux·sec for the Crystal Violet, and 120 lux·sec for the 3,3'-di-(N-ethylcarbazoyl)phenylmethyl iodide.

In the case where the binder resin was not incorporated in the phthalocyanine layer and the photoconductive element was prepared using an aluminum sheet having a mirror surface, the polymer layer was peeled off from the support. In the case where the binder resin was not incorporated in the phthalocyanine layer and the photoconductive element was prepared using an aluminum sheet which had been surface-roughened by a sand paper of #800, cracking occurred at 70° with 10ϕ for the Crystal Violet, and also for the 3,3'-di-(N-ethylcarbazoyl)phenylmethyl iodide. The sensitivities of the persistent photoconductive element were 400 lux·sec for the Crystal Violet, and 100 lux·sec for the 3,3'-di-(N-ethylcarbazoyl)phenylmethyl iodide.

Example 23

Persistent photoconductive elements were prepared in the same manner as described in Example 22 except that dinitrobenzoic acid was used instead of dichloroacetic acid. In the bending test, cracking occurred at 60° with 10ϕ for the Crystal Violet, and also for the 3,3'-di-(N-ethylcarbazoyl)phenylmethyl iodide. The sensitivities of the persistent photoconductive elements were 100 lux·sec for the Crystal Violet, and 30 lux·sec for the 3,3'-di-(N-ethylcarbazoyl)phenylmethyl iodide.

Example 24

Persistent photoconductive elements were prepared in the same manner as described in Example 22 except that polyvinyl pyrrolidone and polyvinyl butyral were respectively used as the binder resin instead of the terpolymer resin of vinyl chloride/vinyl acetate/maleic acid. In the case where Crystal Violet was used as the dye, cracking occurred at 60° with 10ϕ for the polyvinyl pyrrolidone, and at 70° with 10ϕ for the polyvinyl butyral. The sensitivities of the persistent photoconductive elements were 430 lux·sec for both the resins. In the case where 3,3'-di-(N-ethylcarbazoyl)phenylmethyl iodide was used as the dye, cracking occurred at 60° with 10ϕ for both the resins. The sensitivities of the persistent photoconductive elements were 130 lux·sec for both the resins.

Comparative Example 13

A series of persistent photoconductive elements were prepared in the same manner as described in Example 22 except that 2 g of polybutyl methacrylate, polyamide and polyvinyl acetate were respectively used as the binder resin. In the case where Crystal Violet was used as the dye, cracking occurred at 60° with 10ϕ for the polybutyl methacrylate, at 70° with 10ϕ for the polyamide, and at 70° with 10ϕ for the polyvinyl acetate. The sensitivity of the persistent photoconductive element was 1600 lux·sec for the polyvinyl acetate. In the case where 3,3'-di-(N-ethylcarbazoyl)phenylmethyl iodide was used as the dye, cracking occurred at 60° with 10ϕ for the polybutyl methacrylate, at 70° with 10ϕ for the polyamide, and at 60° with 10ϕ for the polyvinyl acetate. The sensitivities of the persistent photoconductive elements were 1200 lux·sec for the polybutyl methacrylate, 1100 lux·sec for the polyamide, and 1200 lux·sec for the polyvinyl acetate.

Example 25

A persistent photoconduct element comprising a polyvinyl carbazole layer containing an organic acid, a dye, a plasticizer and a resin and a phthalocyanine layer containing a binder resin was prepared in the same manner as described in Example 22 except that 0.5 g of biphenyl as the plasticizer and 0.5 g of a terpolymer resin of vinyl chloride/vinyl acetate/maleic acid as the additive resin were further incorporated in the polyvinyl carbazole layer. In the case where Crystal Violet was used as the dye, cracking occurred at 180° with 8ϕ and the sensitivity of the persistent photoconductive element was 420 lux·sec. In the case where 3,3'-di-(N-ethylcarbazoyl)phenylmethyl iodide was used as the dye, cracking occurred at 180° with 8ϕ and the sensitivity of the persistent photoconductive element was 120 lux·sec.

In the case where the composition of the polyvinyl carbazole layer was the same as described above and the binder resin was not used for the phthalocyanine layer, cracking occurred at 120° with 10ϕ for the Crystal Violet, and also for the 3,3'-di-(N-ethylcarbazoyl)-phenylmethyl iodide. The sensitivities of the persistent photoconductive elements were 420 lux·sec for the Crystal Violet and 120 lux·sec for the 3,3'-di-(N-ethylcarbazoyl)phenylmethyl iodide.

Example 26

Each of the persistent photoconductive elements prepared in the foregoing Examples was heat-treated at 150° C. for 5 seconds and was exposed to light by using an image reflecting light exposure apparatus comprising a halogen lamp as the light source. The light exposure quantity was adjusted to 3 to 5 times the persistent photoconductive sensitivity so that optimum light exposure was attained. The standard test chart of the Japan Electrophotography Association was used as the original. Each exposed persistent photoconductive element was set at a copying machine obtained by reworking the U-Bix 1500 (manufactured and sold by Konishiroku Industry Co., Ltd., Japan). The actual machine test was carried out by repeating the operations of electrocharging, development, image transfer and theremal fixation. Each photoconductive element produced copies having such good image quality as a maximum optical density of 1.4, a minimum optical density of 0.06 and a resolving power of at least 8 lines/mm. The image quality remained unchanged in more than 500 copies for each photoconductive element. Then, the persistent latent image was erased by carrying out the heat treatment in the same manner as described above, and imagewise light exposure could be performed again. By repeating the above reproduction process, copies was obtained in the same number as noted above. Each photoconductive element was revived more than 100 times by repeating the above-noted heat treatment.

What is claimed is:

1. A persistent photoconductive element comprising an electroconductive support, a pigment layer formed on said support and composed mainly of a phthalocyanine pigment or Indanthrene Blue GCD of the formula:

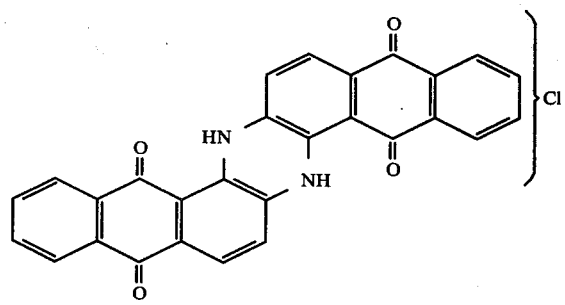

and a polymer layer formed on said pigment layer and composed mainly of a polyvinyl carbazole, said polymer layer containing at least one member selected from the group consisting of aliphatic halogenated hydrocarbons, halogenated acyl compounds, halogenated keto compounds and hydrogen donor compounds.

2. A persistent photoconductive element comprising an electroconductive support, a pigment layer formed on said support and composed mainly of a phthalocyanine pigment or Indanthrene Blue GCD of the formula:

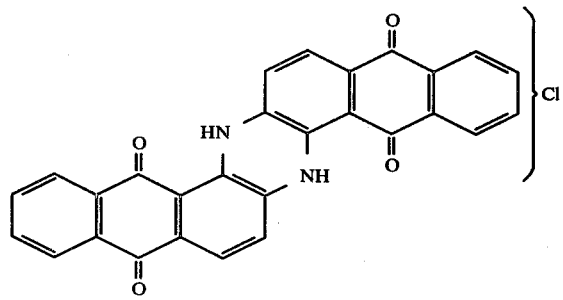

and a polymer layer formed on said pigment layer and composed mainly of a polyvinyl carbazole, said polymer layer containing a dye and at least one member selected from the group consisting of aliphatic halogenated hydrocarbons, halogenated acyl compounds, halogenated keto compounds and hydrogen donor compounds.

3. A persistent photoconductive element according to claim 1 or 2, wherein the pigment layer has a thickness of from 0.01 to 10 microns and the polymer layer has a thickness of from 1 to 30 microns.

4. A persistent photoconductive element according to claim 2, wherein the dye is Crystal Violet, Malachite Green, Rhodamine 6G, Victoria Blue, Rhodamine B or 3,3'-di-(N-ethylcarbazoyl)-phenylmethyl iodide of the formula:

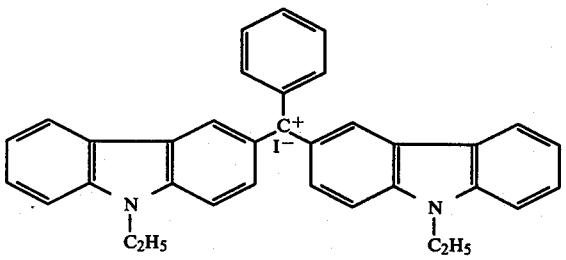

5. A persistent photoconductive element according to claim 1 or 2, wherein the pigment layer further comprises as a binder resin 5 to 200 parts by weight, per 100 parts by weight of the pigment, of at least one member selected from the group consisting of polyvinyl butyral, terpolymer resins of vinyl chloride/vinyl acetate/maleic acid and polyvinyl pyrrolidone.

6. A persistent photoconductive element according to claim 1 or 2, wherein the polymer layer further comprises 0.1 to 20 parts by weight, per 100 parts by weight of polyvinyl carbazole, of at least one plasticizer selected from the group consisting of chlorinated n-paraffins, beta-methylnaphthalene and biphenyl and/or 0.1 to 20 parts by weight, per 100 parts by weight of polyvinyl carbazole, of at least one resin selected from the group consisting of polyvinyl chloride resins, polyvinylidene chloride resins, terpolymer resins of vinyl chloride/vinyl acetate/maleic acid, silicone resins, and xylene resins, provided that the total amount of said at least one plasticizer and said at least one resin is within the range of 0.2 to 20 parts by weight, per 100 parts of polyvinyl carbazole.

7. A persistent photoconductive element according to claim 1 or 2, wherein the pigment layer further comprises as a binder resin 5 to 200 parts by weight, per 100 parts by weight of the pigment, of at least one member selected from the group consisting of polyvinyl butyral, terpolymer resins of vinyl chloride/vinyl acetate/maleic acid and polyvinyl pyrrolidone and the polymer layer further comprises 0.1 to 20 parts by weight, per 100 parts by weight of polyvinyl carbazole, of at least one plasticizer selected from the group consisting of chlorinated n-paraffins, beta-methylnaphthalene and biphenyl and/or 0.1 to 20 parts by weight, per 100 parts by weight of polyvinyl carbazole, of at least one resin selected from the group consisting of polyvinyl chloride resins, polyvinylidene chloride resins, terpolymer resins of vinyl chloride/vinyl acetate/maleic acid, silicone resins and xylene resins, provided that the total amount of said at least one plasticizer and said at least one resin is within the range of 0.2 to 20 parts by weight, per 100 parts by weight of polyvinyl carbazole.

8. A persistent photoconductive element according to claim 1 or 2, wherein the pigment layer still further comprises at least one member selected from the group consisting of aliphatic halogenated hydrocarbons, halogenated acyl compounds, halogenated keto compounds and hydrogen donor compounds.

* * * * *